United States Patent [19]

Kokubo et al.

[11] 4,245,490

[45] Jan. 20, 1981

[54] THIN ROLLED STEEL PLATE HAVING UNEQUAL THICKNESS

[75] Inventors: Ichiro Kokubo, Kakogawa; Seiji Ban, Hyogo; Kensaburo Takisawa; Yuuji Koyama, both of Kobe; Junkiti Kobayashi, Kakogawa; Chosei Ueda, Akashi, all of Japan

[73] Assignee: Kobe Steel, Limited, Kobe, Japan

[21] Appl. No.: 18,764

[22] Filed: Mar. 8, 1979

[30] Foreign Application Priority Data

Mar. 8, 1978 [JP] Japan ..... 53-26805

[51] Int. Cl.[3] ..... B21B 1/00; B21B 1/22

[52] U.S. Cl. ..... 72/234; 72/366; 428/600

[58] Field of Search ..... 72/199, 226, 234, 366; 428/576, 587, 600

[56] References Cited

U.S. PATENT DOCUMENTS

| | | | |
|---|---|---|---|
| 1,688,252 | 10/1928 | Tytus | 72/234 |
| 1,829,339 | 10/1931 | Corrigan et al. | 72/234 |
| 1,895,607 | 1/1933 | Coe | 72/241 |
| 2,732,591 | 1/1956 | Whittum | 72/199 |
| 3,021,737 | 2/1962 | Titze | 72/234 |
| 3,049,950 | 8/1962 | Pearson | 72/6 |
| 3,172,315 | 3/1965 | Fox | 72/16 |
| 3,882,709 | 5/1975 | Kawamoto et al. | 72/234 |
| 4,033,165 | 7/1977 | Arimura et al. | 72/205 |

*Primary Examiner*—Milton S. Mehr

*Attorney, Agent, or Firm*—Oblon, Fisher, Spivak, McClelland & Maier

[57] ABSTRACT

A thin rolled steel plate, and method and apparatus for producing it is disclosed. The thin rolled steel plate is formed with a drum shape in cross-section with a thickness ratio of a central portion to the edge portions of at least 1.1. The rolled steel plate is rolled having a concave drum shape during the rough rolling step and/or the first half of the hot finishing rolling step so as to achieve the desired drum shape. The plate is subsequently rolled in the second half of the hot finishing rolling step and the cold finishing rolling step by concave drum shaped rollers which reduce its thickness while not altering its drum shape.

3 Claims, 21 Drawing Figures

THIN ROLLED STEEL PLATE HAVING UNEQUAL THICKNESS

BACKGROUND OF THE INVENTION

1. Field of the Invention

The present invention relates to a thin rolled steel plate having a so-called drum shape in cross section in which the thickness of the plate gradually increases from both edge portions toward a central portion as a result of hot rolling or hot rolling and cold rolling, to a method of producing the same and to an apparatus for producing same.

2. Description of the Prior Art

Conventional steel plates available in the market have roundness of a so-called crown shape in which the thickness of the plate at both edges is thinner by about 0.01 mm than that of the central portion. Therefore, the thickness of the conventional plates are nearly equal, exhibiting flatness to a sufficient degree. However, if the thickness of the steel plate having equal thickness is greatly reduced to minimize the weight of outer plates used, for instance, for automobiles, the panel stiffness of the plate is markedly decreased in the central portions, depriving the plates of practical value.

SUMMARY OF THE INVENTION

In order to meet the requirement for reducing the weight of the outer plates used for automobiles, the present invention presents novel rolled thin steel plates having unequal thickness of a so-called super-crown shape resembling a drum in cross section, which are so rolled by way of hot rolling or hot rolling and cold rolling that the thickness of the plates gradually increases from the edge portions to the central portion, i.e., which are so rolled that the thickness ratio of the central portion to the edge portions is not less than 1.1. In other words, the present invention provides thin steel plates in which the panel stiffness at the central portion of the plates is stronger than that of the edge portions, so that the steel plates will exhibit sufficient panel stiffness even when the weight of the plates is reduced, and further provides a method and apparatus of producing the same.

In order to accomplish the abovementioned objects, the inventors of the present invention have conducted a variety of experiments and have found that the steel plates can be more efficiently rolled by a rolling mill so as to have a super-crown shape if rolls of a concave drum shape are employed than by subjecting the steel plates to pre-shaping or by drawing the rolls. They have also found that proper surface shape such as flatness can be more efficiently imparted to the rolled thin steel plates if the steel plates are so formed as to have a super-crown shape during the steps of the roughing rolling and/or the former-half of the hot finishing rolling and if flatness is imparted to the steel plates in the subsequent steps, beginning with the latter-half of the hot finishing rolling than to give the super-crown shape to the steel plates by means of cold rolling. Finally they have found that even if the super-crown shape is imparted to the steel plates in the initial stage of the hot rolling, there is no adverse effects to the running or shaping properties of the steel plates, or shaping and processing in the subsequent steps, as compared with the conventional steel plates have equal thickness.

Therefore, according to the present invention, the rolled thin steel plates having unequal thickness are produced by subjecting a slab to hot rolling, cold rolling and temper rolling. Concretely speaking, a slab is so rolled by means of concave drum-shaped rolls that the thickness ratio of the steel plate from the central portion of the edge portions is not less than 1.1 during the steps of the roughing rolling and/or the former-half of the hot finishing rolling, and the thus rolled steel plate is shaped in a subsequent rolling step to have a reduced thickness of a similar figure nearly maintaining the abovementioned thickness ratio of the plate.

Further, according to the method of the present invention of producing thin rolled steel plates having a thickness ratio at the central portion to the edge portions of 1.1 or greater, a slab is shaped by means of concave drum-shaped rolls during the steps of the roughing rolling and/or the former-half of the hot finishing rolling such that the thickness ratio at the central portion to the edge portions of the steel plate is greater than 1.1, and the thus rolled steel plate is subjected to the subsequent steps of finishing rolling based on hot rolling, cold rolling and temper rolling to reduce the thickness of the plate while nearly maintaining the abovementioned thickness ratio.

Furthermore, according to the apparatus of the present invention, a rolling mill produces thin rolled steel plates having unequal thickness and a thickness ratio a the central portion to the edge portions of greater than 1.1 by subjecting a slab to the hot rolling, cold rolling and temper rolling, employing rolls of a concave drum-shaped construction such that the steel plates will have a thickness ratio at the central portion to the edge portions which is close to the abovementioned ratio while the steel plate is being rolled at least during the hot roughing rolling. Here, the actual number of rolling mills operated according to the pass schedule of rolling is halved so that the former half will serve as a prestage of the hot rolling mill.

BRIEF DESCRIPTION OF THE DRAWINGS

Various other objects, features and attendant advantages of the present invention will be more fully appreciatd as the same becomes better understood from the following detailed description when considered in connection with the accompanying drawings, wherein like reference characters designate like or corresponding parts throughout the several views, and wherein.

DETAILED DESCRIPTION OF THE PREFERRED EMBODIMENTS

Figure 1A:
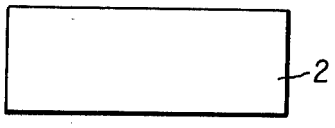
FIG. 1(*a*) through 1(*c*) are cross-sectional views of each of the results of the steps for producing steel plates according to the present invention.
Figure 1B:
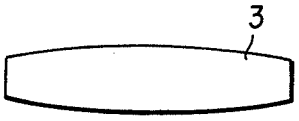
Figure 1C:
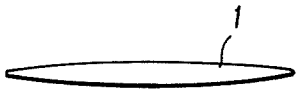

FIG. 1(*c*) is a lateral cross-sectional view of a thin rolled steel plate 1 having unequal thickness according to the present invention, having roughly a drum-like shape and measuring, for example, 1350 mm in width, 0.60 mm in thickness at both edges, and 0.75 mm in thickness at the central portion, the difference in thickness between the central portion and edge portions being 0.15 mm. FIG. 1(*a*) is a lateral cross-sectional view of a slab 2 which is the raw material for making the thin steel plate shown in FIG. 1(*c*), having roughly a rectangular shape and measuring, for instance, 1380×200 mm in cross-sectional dimension. FIG. 1(*b*) is a lateral cross-sectional view of a steel plate 3 obtained by subjecting the slab to hot rolling, having roughly a drumlike shape measuring, *for example,* 1350 mm in width, 2.25 mm in thickness at both edges and 2.80 mm in thickness at the central portion, the difference in thickness between the central portion and the edge portions being 0.55 mm. The thin steel plate shown in FIG. 1(*c*) can be obtained by subjecting the steel plate of FIG. 1(*b*) to cold rolling and temper rolling.

Figure 2A:
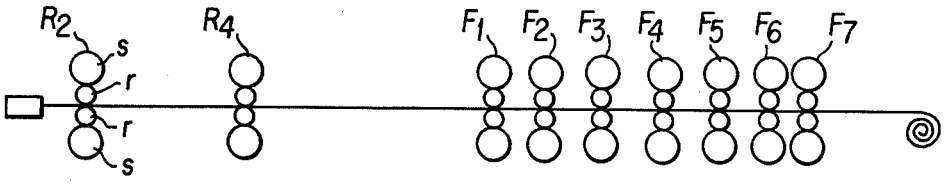
FIGS. 2(*a*) through 2(*c*) are views schematically showing the apparatus for producing steel plates according to the present invention.
Figure 2B:
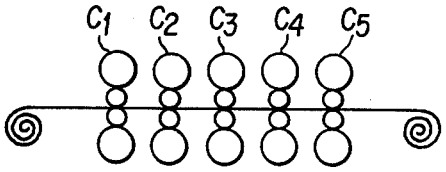
Figure 2C:
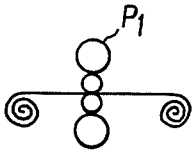
Figure 3A:
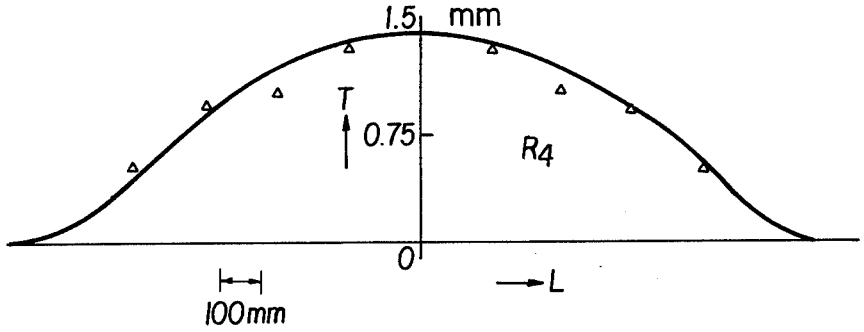
FIGS. 3(*a*) through 3(*f*) are views showing shapes of the rolls used for the rolling mills of FIG. 2.
Figure 3B:
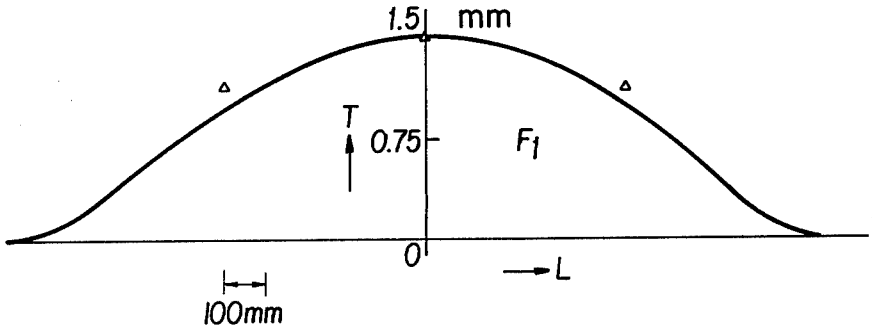
Figure 3C:
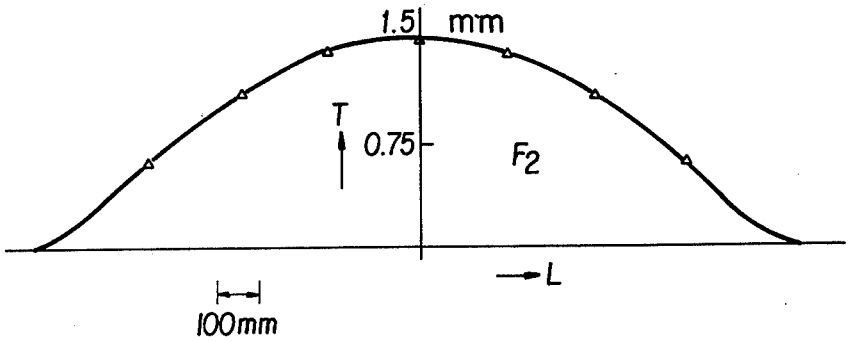
Figure 3D:
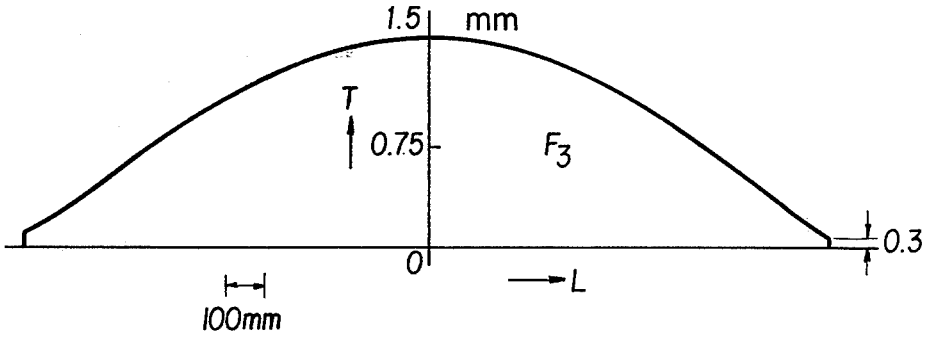
Figure 3E:
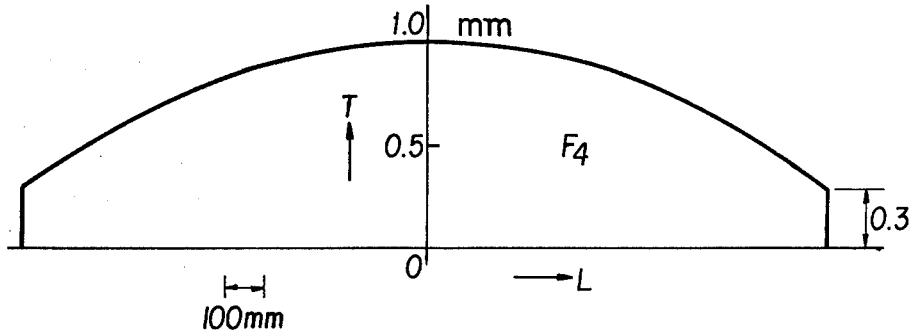
Figure 3F:
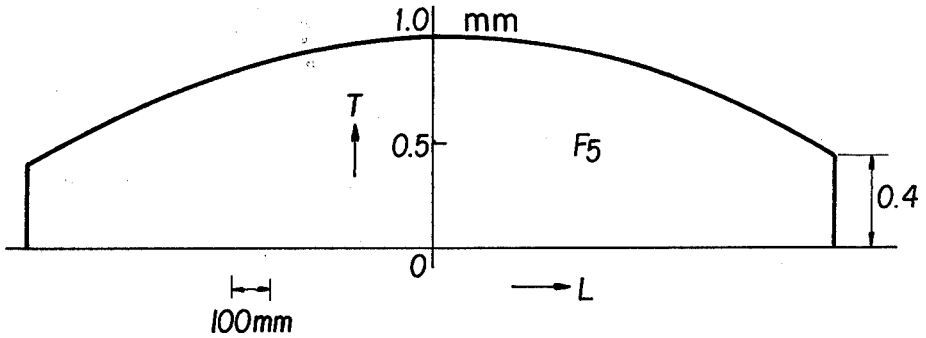
Figure 4A:
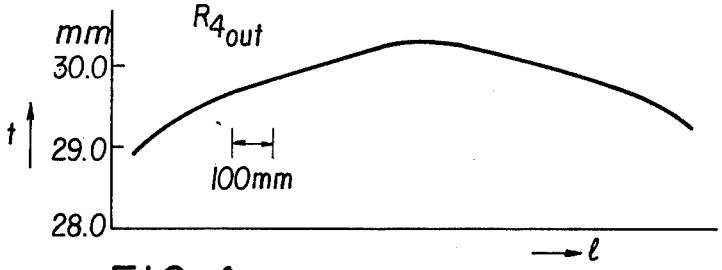
FIGS. 4(*a*) through 4(*g*) are cross-sectional views showing the steel plates produced by the apparatus of FIG. 2.
Figure 4B:
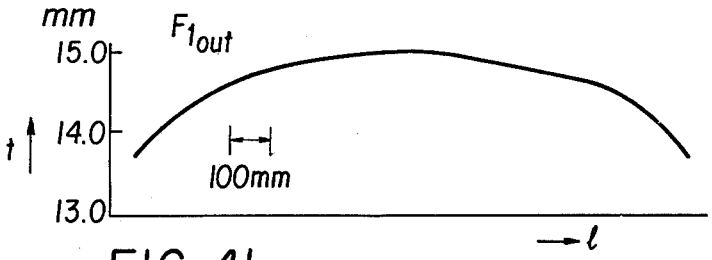
Figure 4C:
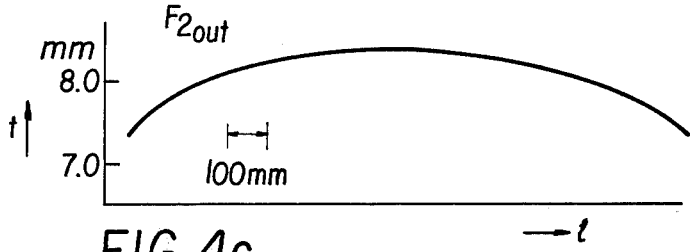
Figure 4D:
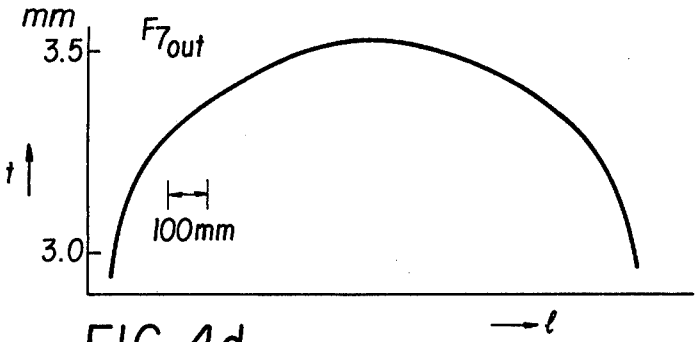
Figure 4E:
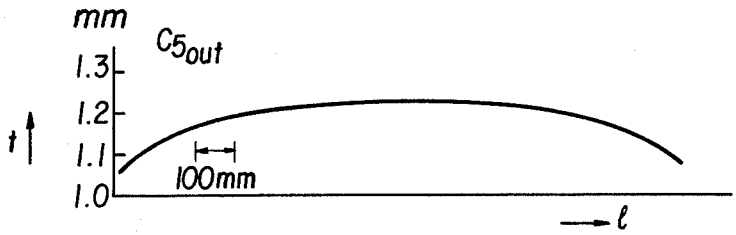
Figure 4F:
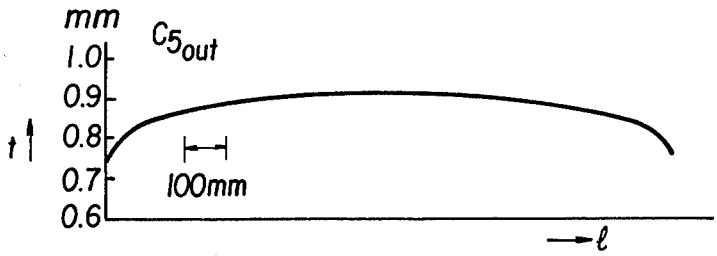
Figure 4G:
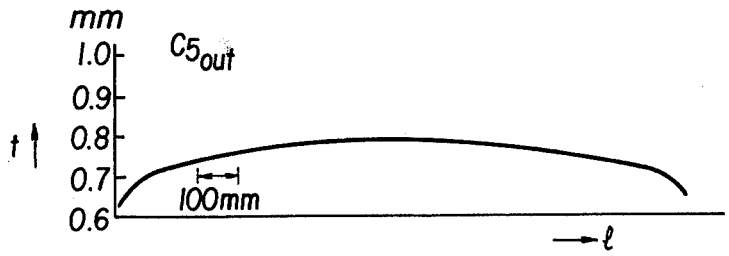

FIG. 2 shows a series of rolling mills for shaping a thin steel plate shown in FIG. 1, in which FIG. 2(*a*) shows a group of rolling mills for hot rolling, consisting of two roughing mills $R_2$ and $R_4$, rolling mills $F_1$, $F_2$ and $F_3$ constituting the former-half of finishing rolling, and rolling mills $F_4$, $F_5$, $F_6$ and $F_7$ constituting the latter-half of finishing rolling, FIG. 2(*b*) shows five subsequent rolling mills $C_1$, $C_2$, $C_3$, $C_4$ and $C_5$, and FIG. 2(*c*) shows a further subsequent temper mill $P_1$. Each rolling mill consists of a pair of work rolls r and back-up rolls s. The roughing mills may be of a tandem type. Although not diagramatized, the rolls of the roughing mill $R_2$ are of a cylindrical shape having nearly an equal diameter in the axial direction. The rolls of the subsequent roughing mills $R_4$ and finishing mills $F_1$, $F_2$, $F_3$, $F_4$, $F_5$, $F_6$, and $F_7$ are of concave a drum shape having diameters increasing toward both edges and gradually decreasing toward the central portion as diagramatized in FIGS. 3(*a*) through (*f*), the difference in diameter between the edge portions and the central portion being nearly 0.60 mm or greater, such that the steel plate rolled through the mills $R_4$, $F_1$, $F_2$, $F_3$, $F_4$ and $F_5$ will have a thickness of about 2.8 mm to 3.5 mm, and the thickness ratio at the central portion to the edge portions will be at least 1.1 or more as viewed from the output side of the mill $F_2$. Further, although not diagramatized, the rolls of the subsequent mills $C_1$, $C_2$, $C_3$, $C_4$, $C_5$ and $P_1$ are of a drum shape with their diameters gradually decreasing from the edge portions toward the central portion, such that the steel plate is shaped to have a reduced thickness nearly maintaining the same thickness ratio of the central portion to the edge portions as that viewed from the output side of the abovementioned mill $F_2$.

FIG. 4 shows actual shapes of the steel plate successively shaped through the rolling mills of FIG. 2, in which FIG. 4(*a*) shows the shape after the steel plate has passed through the rolling mill $R_4$, FIG. 4(*b*) shows the shape after the steel plate has passed through the rolling mill $F_1$, FIG. 4(*c*) shows the shape after the steel plate has passed through the rolling mill $F_2$, FIG. 4(*d*) shows the shape after the steel plate has passed through the rolling mill $F_7$, FIG. 4(*e*) shows the shape after the steel plate has passed through the rolling mill $C_5$, and FIGS. 4(*f*) and (*g*) also show the shapes of steel plates having different thickness after they have passed through the rolling mill $C_5$. The steel plate is so shaped that the thickness ratio of the central portion to the edge portions is not less than 1.1 as viewed from the output side of the rolling mill $F_2$, and is further so shaped as to have a reduced thickness of a similar figure nearly maintaining the same thickness ratio as the abovementioned thickness ratio as viewed from the output sides of the rolling mills $F_7$ and $C_5$. That is, the shape of the steel plate after having passed through the cold rolling mill $C_5$ is nearly the same as the shape of the steel plate after having passed through the hot rolling mill $F_7$. In other words, the shape of the steel plate is mostly determined by the hot rolling. If the shape of the steel plate is changed between the inlet side and outlet side of the cold rolls, the deformation of the steel plate will be corrected very little through the step of cold rolling, whereby the surface shape characteristics such as the flatness of the steel plate subjected to the forcible shaping will become unsuitable, degrading the quality of the steel plate. On the other hand, if the shape of the steel plate is mostly determined in the final step of hot rolling as done by the present invention, the steel plate may be so shaped as to have a reduced thickness maintaining nearly a similar figure during the step of cold rolling. Thus, since the steel plate is less subjected to deformation in the step of cold rolling, the surface shape characteristics of the steel plate such as the flatness can be properly maintained. Further, even when the shape of the steel plate is greatly changed in the final step of hot rolling, the shaping is not so severe for the steel plate because it is in the step of hot rolling. Further, the steel plate still having a sufficient thickness exhibits strong rigidity to maintain proper surface shape such as flatness. Besides, the steel plate having sufficient thickness at the edge portions does not develop deformation at the edge portions. However, even during the step of hot rolling, if the shape of the steel plate is excessively shaped through the latter-half of the finishing rolling, the surface state characteristics such as the flatness of the steel plate will contain stress. Therefore, the shape of the steel plate should be determined in the steps of the roughing rolling and/or the former-half of the hot finishing rolling. By so doing, uniform elongation will be imparted to the steel plate in the direction of its width within a small range of elongation, and the surface state characteristics such as the flatness can be properly maintained, making it possible to obtain a thin steel plate maintaining a desired shape as shown in FIG. 1(*c*) and having such a super-crown shape as shown in FIG. 4(*e*) through (*g*). Thus, the shape of the rolls of rolling mills in each of the steps effectively participates in determining the super-crown shape of the steel plate and in maintaining the super-crown shape of the steel plate in the subsequent steps of cold rolling.

For this purpose, according to the apparatus of the present invention, as shown in FIG. 3, the rolls of the rolling mills, at least those used for the steps of hot rolling, are formed in a concave a drum shape such that the thickness ratio of the central portion to the edge portions of the steel plate shaped by the rolls of the roughing mill is approximately 1.1 or greater, and such that the relationship $Cc/C_H = t_c/t_H$ is satisfactory in the subsequent rolling mills, wherein $C_c$: the thickness ratio of the central portion to the edge portions of the steel plate on the inlet side of the rolls.

$C_H$: the thickness ratio of the central portion to the edge portions of the steel plate on the outlet side of the rolls.

$t_c$: the thickness of the central portion of the steel plate on the inlet side of the rolls.

$t_H$: the thickness of the central portion of the steel plate on the outlet side of the rolls.

Figure 5A:
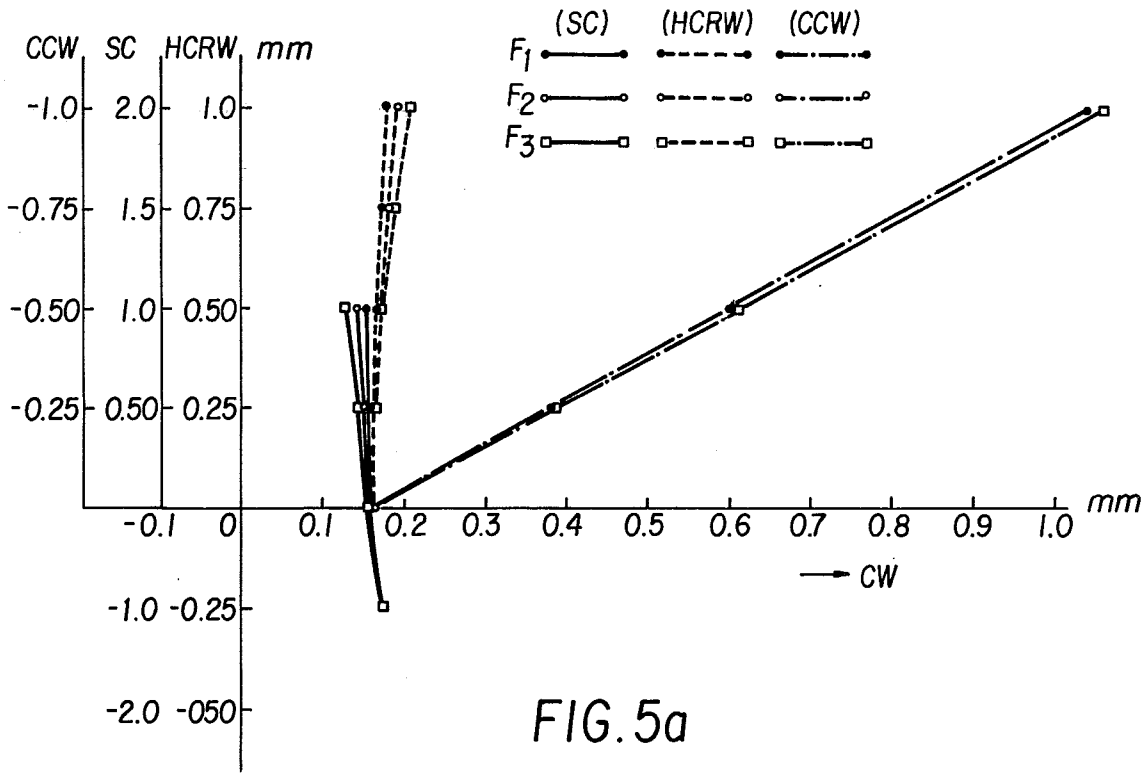
FIGS. 5(*a*) and 5(*b*) are graphs of curves showing relations between the steel plates produced and the rolls.
Figure 5B:
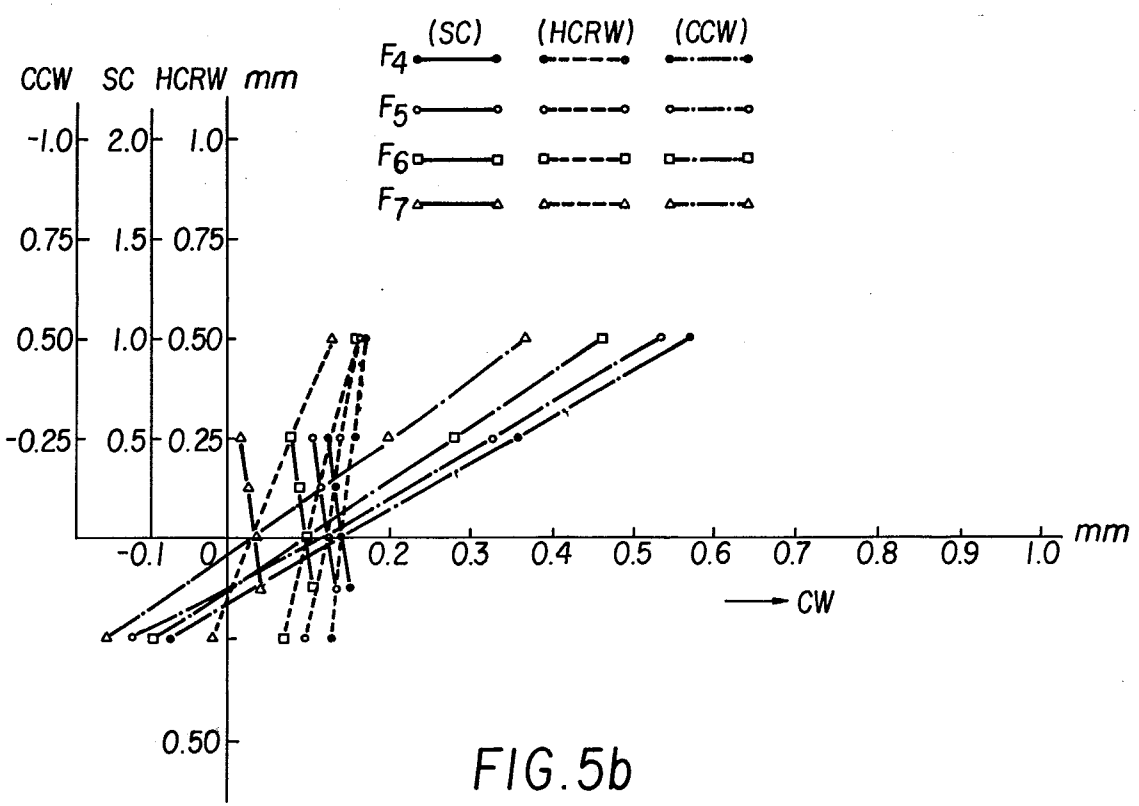

FIG. 5 shows the shape of the rolls of each of the rolling mills which is most effective for imparting the super-crown shape to the steel plates. FIG. 5 shows the case when the steel plate is rolled using rolls having initial crowns of concave dissimilar sizes (CCW), i.e., having rolls of drum shapes with dissimilar recesses of the mills $R_4$, F, $F_2$, $F_3$, $F_4$, $F_5$, $F_6$ and $F_7$, the case when the steel plate is rolled using rolls having dissimilar rolling gaps (SC), i.e., using rolls having dissimilar drawing margins of the rolling mills, and the case when the steel plate is rolled while preliminarily imparting a drum-shaped crown to the steel plate on the inlet side of the rolls (HCRW), i.e., while imparting dissimilar center-to-edge thickness ratios before the steel plate enters each of the rolling mills. With reference to the excess thickness (CW) of the central portion to the edge portions of the steel plate as viewed from the outletside of each of the rolling mills, i.e., with reference to the crown of the steel plate shaped by each of the rolling mills, it will be recognized that the case of the rolls of the rolling mills formed in the concave drum shape is capable of imparting greater edge-to-center thickness ratio to the steel plate than the other two cases: Table 1 shows the difference in thickness between the edge portions and the central portion of the steel plate on the outlet side of each of the rolling mills $F_1$, $F_2$, $F_3$, $F_4$, $F_5$, $F_6$ and $F_7$, in relation to the radius ratio of the rolls, rolling gap ratio of the rolls, and the thickness of the steel plate on the inlet sides.

TABLE 1

| | $F_1$ | $F_2$ | $F_3$ | $F_4$ | $F_5$ | $F_6$ | $F_7$ |
|---|---|---|---|---|---|---|---|
| SC | 0.0133 | 0.0207 | 0.0287 | 0.0360 | 0.0400 | 0.0360 | 0.0347 |
| HCRW | 0.0093 | 0.0160 | 0.0280 | 0.0573 | 0.0853 | 0.1267 | 0.200 |
| CCW | −0.877 | −0.806 | −0.903 | −0.855 | −0.865 | −0.739 | −0.683 |
| SC | rolling gap in mm | | | | | | |
| HCRW | plate thickness in mm | | | | | | |
| CCW | radius ratio of roll when crown protruded (+) and when crown recessed (−) in mm | | | | | | |

The shapes of the steel plates shown in FIG. 4 were obtained when the difference in radii between both edge portions and the central portion of the upper and lower concave drum-shaped rolls of the rolling mills $R_4$, $F_1$, $F_2$, $F_3$, $F_4$, $F_5$, $C_1$, $C_2$, $C_3$, $C_4$, $C_5$, $P_1$ were respectively set at −1.50 mm, −1.50 mm, −1.50 mm, −1.20 mm, −0.70 mm, −0.60 mm, −0.20 mm, −0.10 mm, −0.04 mm, −0.05 mm, the temperature for heating the slab was set at 1200° C., the temperature on the outlet side of the rolling mill $R_4$ was set at 1100° C., the temperature on the inlet side of the rolling mill $F_1$ was set at 1040° C., and the temperature on the inlet side of the rolling mill $C_1$ was set at 25° C., and when the pass schedule of the rolling mills, such as the rolling speed of the rolls, was set as shown in Table 2. It has been confirmed that the thin steel plate obtained as a final product from the temper mill $P_1$ possessed a super-crown shape with a center-to-edge thickness ratio of not less than 1.1 as shown in Table 3, and the flatness of the thin steel plate was zero in terms of steepness, exhibiting proper surface properties, thereby presenting sufficient panel stiffness in the central portion. In addition, the steel plate obtained according to the present invention weighed 4.0% less as compared with the steel plate having the same panel stiffness and equal thickness.

TABLE 2 (I)

| Working step | Rolling mill | $R_2$ | | $R_4$ | | |
|---|---|---|---|---|---|---|
| | Number of passes | 1 | 2 | 3 | 4 | 5 |
| | Plate thickness (mm) | 130 | 105 | 75 | 45 | 30 |
| | Rolling load (tons) | 1008 | 1081 | 1432 | 1527 | 1860 |
| | Rolling speed (rpm) | 29 | 29 | 40 | 60 | 75 |
| | Work roll crown (mm) | — | — | −1.50 | −1.50 | −1.50 |
| Rolling from a thickness of 16.5 mm into 3.5 mm | Rolling mill | $F_1$ | $F_2$ | $F_3$ | $F_4$ | $F_5$ |
| | Plate thickness (mm) | 15.2 | 9.0 | 6.0 | 4.7 | 3.5 |
| | Rolling load (tons) | 2318 | 2242 | 1699 | 1962 | 970 |
| | Rolling speed (rpm) | 42 | 75 | 112 | 155 | 209 |
| | Work roll crown (mm) | −1.50 | −1.50 | −1.20 | −0.70 | −0.60 |

TABLE 2 (II)

| Working step | Rolling mill | $C_1$ | $C_2$ | $C_3$ | $C_4$ | $C_5$ | $P_1$ |
|---|---|---|---|---|---|---|---|
| | Plate thickness (mm) | 2.50 | 1.74 | 1.25 | 0.97 | 0.90 | 0.90 |
| Rolling from a | Rolling load (tons) | 1342 | 1098 | 1087 | 1049 | 993 | 675 |

TABLE 2 (II)-continued

| Working step | Rolling mill | $C_1$ | $C_2$ | $C_3$ | $C_4$ | $C_5$ | $P_1$ |
|---|---|---|---|---|---|---|---|
| thickness of 3.5 mm into 0.90 mm | Rolling speed (rpm) | 85 | 136 | 184 | 238 | 250 | Suitably adjusted |
| | Work roll crown (mm) | −0.2 | −0.1 | −0.04 | 0.0 | 0.0 | −0.05 |

TABLE 2 (III)

| Working step | Rolling mill | $C_1$ | $C_2$ | $C_3$ | $C_4$ | $C_5$ | $P_1$ |
|---|---|---|---|---|---|---|---|
| | Plate thickness (mm) | 2.28 | 1.53 | 1.12 | 0.82 | 0.75 | 0.75 |
| Rolling from a thickness of 3.5 mm into 0.75 mm | Rolling load (tons) | 1298 | 1074 | 1130 | 1074 | 1270 | 700 |
| | Rolling speed (rpm) | 42 | 70 | 95 | 138 | 144 | Suitable adjusted |
| | Work roll crown (mm) | −0.2 | −0.1 | −0.04 | 0.0 | 0.0 | −0.05 |

TABLE 3

| | Plate thickness at the central portion | Width | Length | Amount of crown |
|---|---|---|---|---|
| (1) | 0.75 mm | 1350 mm | 1580 mm | 0.105 mm |
| (2) | 0.90 mm | 1350 mm | 1580 mm | 0.120 mm |
| (3) | 1.20 mm | 1350 mm | 1580 mm | 0.145 mm |

In the abovementioned embodiment, no problem was presented in regard to the running property of the steel plate on the hot run table, winding property of the steel plate by means of a coiler, and washing of scale with acid.

As mentioned with reference to the aforementioned embodiment, a series of rolling mills for hot-rolling, cold-rolling and temper-rolling the slab, employ rolls of a drum shape at least for the hot roughing rolling of the steel plate at the central portion to the edge portions of not less than 1.1, or such that the slab is shaped to have a thickness ratio at the central portion to the edge portion of not less than 1.1 through the steps of the roughing rolling and/or the former-half of the hot finishing rolling. Thereafter, the steel plate is shaped to have a reduced thickness of similar figure nearly maintaining the abovementioned thickness ratio through the subsequent steps of the latter-half of the hot finishing rolling, cold rolling and temper rolling, in order to obtain a thin rolled steel plate of an unequal thickness, i.e., of a drum shape having a thickness ratio at the central portion to edge portions of not less than 1.1. Therefore, using simply constructed rolling mills in the present invention, it is possible to obtain a thin steel plate having reduced weight, sufficient strength and particularly great panel stiffness in the central portion.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A thin rolled steel plate having unequal thickness produced by hot-rolling and/or cold-rolling a slab, wherein said steel plate is formed in the shape of a drum so as to have a thickness ratio of a central portion to edge portions of at least 1.1 during the step of roughing rolling and/or the first half of the step of hot finishing rolling and is shaped to have a reduced thickness of a similar figure in subsequent rolling steps substantially maintaining said thickness ratio.

2. A method of producing a thin rolled steel plate having unequal thickness and a thickness ratio of a central portion to edge portions of at least 1.1 and comprising shaping a slab in a mill having concave drum-shaped roughing rolls and finishing rolls, said method including the steps of shaping said plate so as to have a thickness ratio at a central portion to edge portions of at least 1.1 during the step of roughing rolling and/or the first half of the step of hot finishing rolling, and shaping said rolled slab to have a reduced thickness of a similar figure in subsequent steps of the second half of the hot finishing rolling and cold rolling while substantially maintaining said thickness ratio.

3. A rolling mill used for producing thin rolled steel plates having unequal thickness and a thickness ratio of a central portion to edge portions of at least 1.1 by hot-rolling and/or cold-rolling a slab wherein said mill includes roughing rolls, finishing rolls and cold rolls and all of the rolls of said rolling mill used for the hot rolling are formed in the shape of a concave drum having a diameter at a central portion which is less than the diameters at the edge portions such that a thickness ratio at the central portion to said edge portions of the steel plate shaped by said rolls is close to said thickness ratio of said plate.

* * * * *